US006331696B1

(12) United States Patent
Nakamura et al.

(10) Patent No.: US 6,331,696 B1
(45) Date of Patent: Dec. 18, 2001

(54) WET TISSUE WARMER AND TISSUE LIFTING PLATE

(75) Inventors: Keiichi Nakamura; Tomihisa Kaneko; Kazunao Ogura, all of Urawa (JP)

(73) Assignee: Combi Corporation, Tokyo-To (JP)

( * ) Notice: Subject to any disclaimer, the term of this patent is extended or adjusted under 35 U.S.C. 154(b) by 0 days.

(21) Appl. No.: 09/661,786

(22) Filed: Sep. 14, 2000

(30) Foreign Application Priority Data

Sep. 14, 1999 (JP) ..... 11-260693
Sep. 14, 1999 (JP) ..... 11-260694

(51) Int. Cl.[7] ..... F24C 7/10
(52) U.S. Cl. ..... 219/386; 219/521; 219/533
(58) Field of Search ..... 219/214, 386, 219/387, 385, 521, 522, 524, 533

(56) References Cited

U.S. PATENT DOCUMENTS 3,947,134 * 3/1976 Ogawa ..... 219/214
4,084,080 * 4/1978 McMahan ..... 219/386
4,694,973 * 9/1987 Rose et al. ..... 219/385
4,700,048 * 10/1987 Levy ..... 219/386
4,890,205 * 12/1989 Shaffer ..... 219/386
4,918,290 * 4/1990 DeMars ..... 219/386
4,943,705 * 7/1990 Halloran ..... 219/385
5,004,894 * 4/1991 Whitehead ..... 219/521
5,036,178 * 7/1991 Orbach ..... 219/385
5,210,396 * 5/1993 Sanders ..... 219/521
5,231,266 * 7/1993 Warren ..... 219/521
6,005,227 * 12/1999 Pappas ..... 219/386
6,046,436 * 4/2000 Hunts ..... 219/386

* cited by examiner

*Primary Examiner*—Teresa Walberg
*Assistant Examiner*—Fadi H. Dahbour
(74) *Attorney, Agent, or Firm*—Wenderoth, Lind & Ponack, L.L.P.

(57) ABSTRACT

A wet tissue warmer includes: a case (2) having an open end (2*a*), a lid (3) removably put on the case (2) so as to cover the open end (2*a*) of the case (2) and internally provided with a heater, and a lifting plate (9) placed in the case (2) and biased upward. When the lid (3) is closed, a wet tissue package (A) mounted on the lifting plate (9) is kept in contact with the lid (3) to heat the wet tissue package (A). Lifting plate locking devices (11) are disposed in the case (2). The lifting plate (9) is locked at the present position by the lifting plate locking devices (11) when the lid (3) is opened.

8 Claims, 13 Drawing Sheets

WET TISSUE WARMER AND TISSUE LIFTING PLATE

BACKGROUND OF THE INVENTION

1. Field of the Invention

The present invention relates to a wet tissue warmer.

2. Description of the Related Art

Disposable wet tissues are used prevalently in substitution for small damp towels for wiping hands, kitchen uses, cleaning toilets, clearing up babies' and sick persons' mess and such. Containers for containing disposable wet tissues are classified roughly into bolt type (cylindrical) containers, box type (box-shaped) containers and pouch type containers.

Wet tissues are cold in a cold season and hence there is the possibility that wet tissues give babies and sick persons an unpleasant feeling when wet tissues for cleaning up babies, and sick persons' mess are used in a cold season, such as winter.

Wet tissue warmers have been used to warm wet tissues. However, wet tissue warmers consume power and take a long time to heat wet tissues at an optimum temperature, and wet tissue warmers of a large capacity are necessary to heat wet tissues quickly at an optimum temperature.

The applicant of the present application previously invented a wet tissue warmer and made an application for patent (JP-A No. Hei 8-117137). This wet tissue warmer has a wet tissue container provided with a lid, and heating device attached to the inner surface of the lid. A stack of wet tissues id pressed against the heating device to heat the upper layers of wet tissues.

FIG. 13 shows this wet tissue warmer 100.

The wet tissue warmer 100 includes a case 103, a lifting plate 102 placed in the case 103, springs 101 biasing the lifting plate 102 upward, and a removable lid 104 covering an open upper end 103*a* of the case 103. The lid 104 is provided in its central part with a tissue dispensing opening 105 covered with a small cover 106. A heating unit 107 is formed by placing a heater 108 in a region excluding a region in which the tissue dispensing opening 105 is formed on the inner surface of the lid 104.

As shown in FIG. 13, a wet tissue package A is placed on the lifting plate 102 of the wet tissue warmer 100. The wet tissue package A is pressed against the heating unit 107 on the lid 104 for heating by the resilience of the springs 101. When using wet tissues a, the small cover 106 is opened and the wet tissues a are taken out one by one.

The wet tissue warmer 100 is able to heat a portion of the wet tissue package A near a tissue dispensing part selectively and hence wet tissues a to be used at present can be efficiently heated.

Since the wet tissue package A contained in this wet tissue warmer 100 is pressed against the inner surface of the lid 104, i.e., the lower surface of the heating unit 107, a high resistance acts on the wet tissue a when the wet tissue a is taken out and hence the wet tissue a cannot be easily taken out. If the pressure applied to the wet tissue package A is reduced to enable the wet tissues a to be taken out easily, it is possible that the wet tissue a cannot be closely pressed against the inner surface of the lid 104 and cannot be satisfactorily heated.

SUMMARY OF THE INVENTION

Accordingly, it is an object of the present invention to provide a wet tissue warmer capable of solving the foregoing problems, of satisfactorily heating a wet tissue to be used at present and of facilitating taking out a wet tissue.

According to the present invention, a wet tissue warmer for warming a wet tissue package including a wet tissue includes a case having an open end, a lid removably put on the case so as to cover the open end of the case and internally provided with a heater, a lifting plate placed in the case, supporting the wet tissue package and biased upward so as to press the wet tissue package against the lid by a first spring, and movement obstructing means for obstructing upward movement of the lifting plate.

According to the present invention, the lifting plate placed so as to be movable in the case of the wet tissue warmer has a raised central part.

According to the present invention, the movement obstructing means, such as a locking means, locks the lifting late to prevent the lifting plate from biasing the wet tissue package when a wet tissue is taken out.

Accordingly, according to the present invention, the wet tissue package is pressed by a high force against the lid with the built-in heater to sufficiently heat a wet tissue when the wet tissue is not used. When the wet tissue is used, the pressing of the wet tissue package against the lid is prevented to facilitate taking out wet tissues.

DESCRIPTION OF THE PREFERRED EMBODIMENTS

Wet tissue warmers according to the present invention will be described hereinafter with reference to the accompanying drawings.

Figure 1:
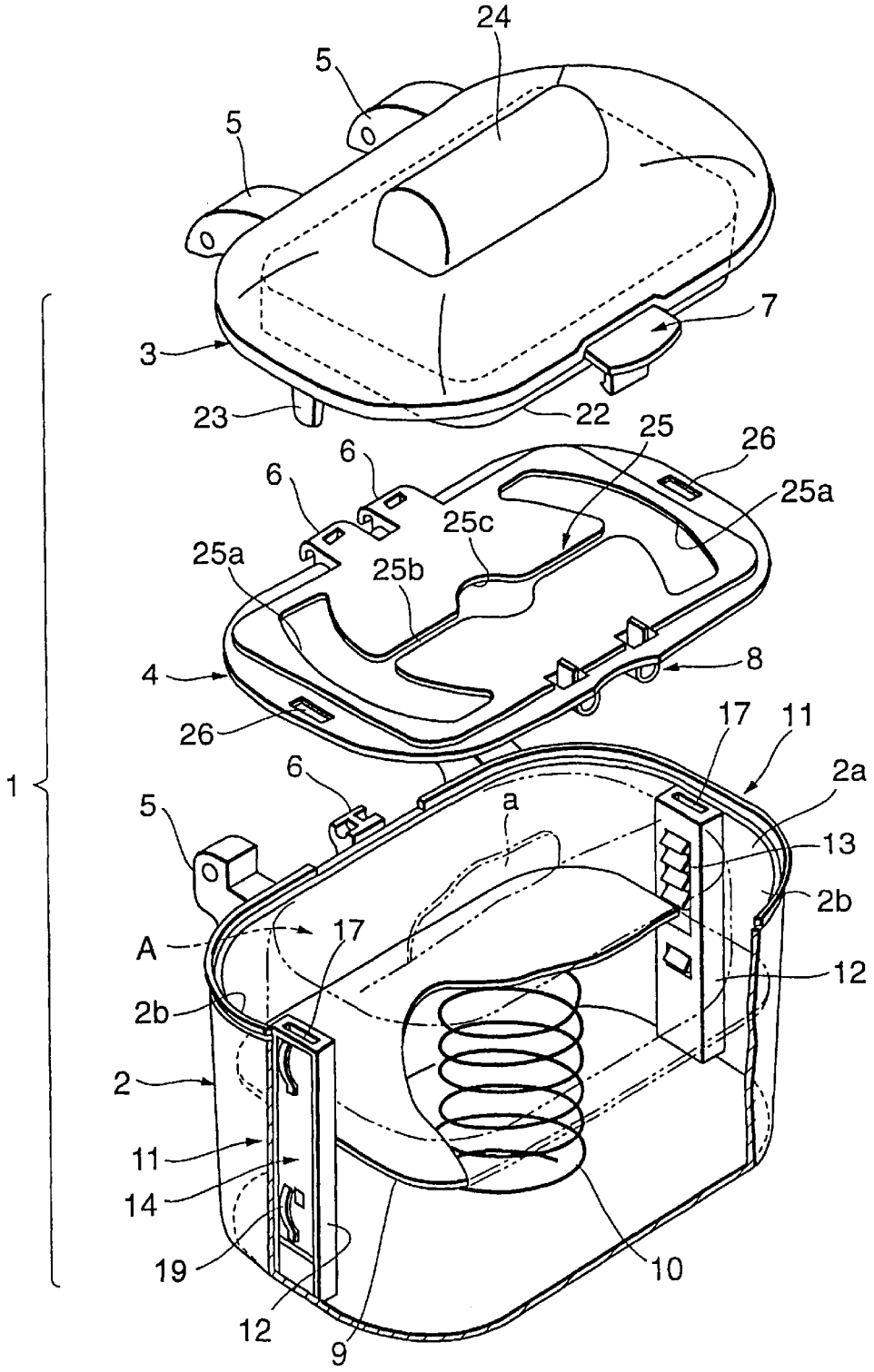
FIG. 1 is an exploded perspective view of a wet tissue warmer in a first embodiment according to the present invention.
Figure 2:
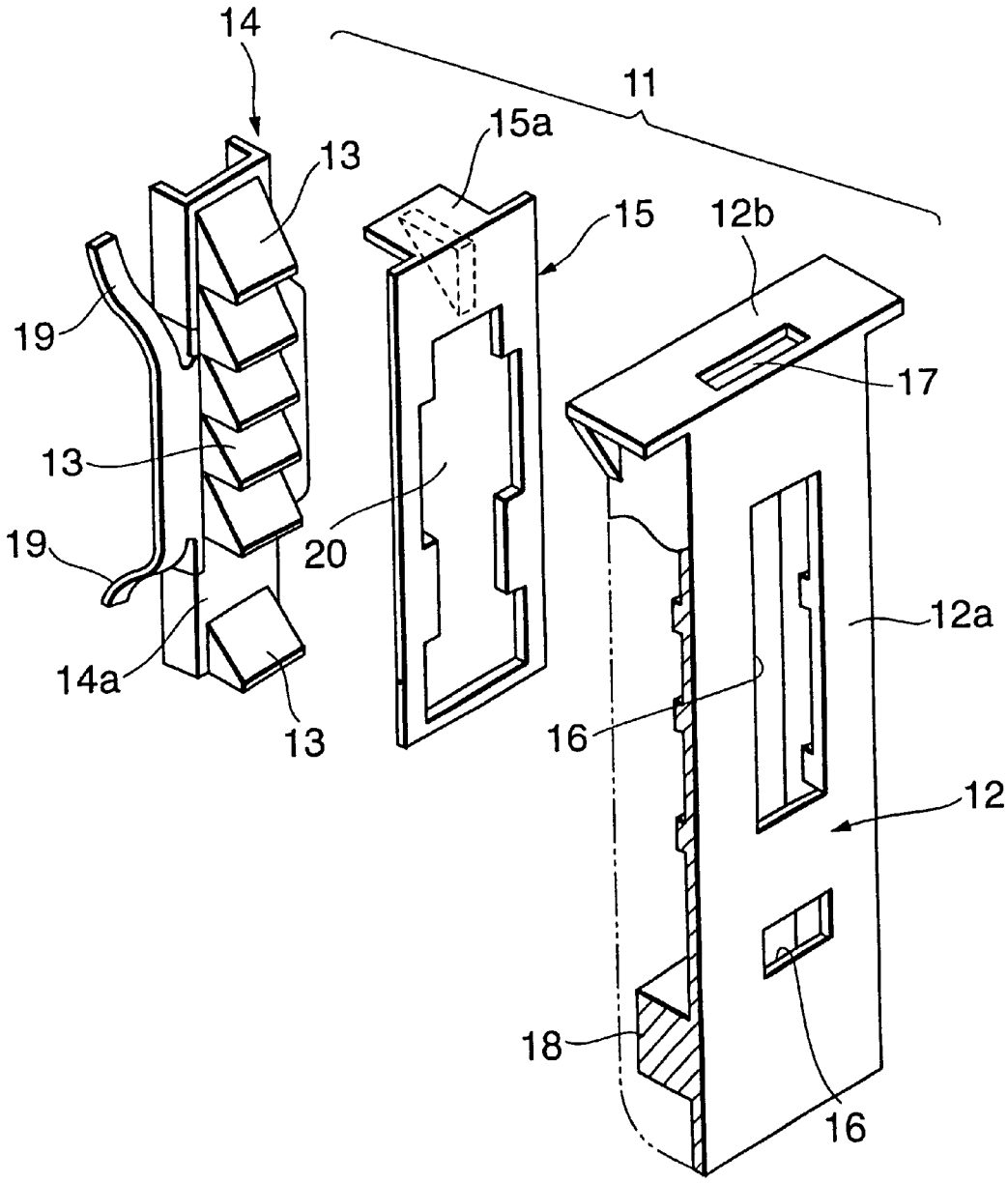
FIG. 2 is an exploded perspective view of a lifting plate locking device, which is a principal part of the wet tissue warmer shown in FIG. 1.
Figure 3A:
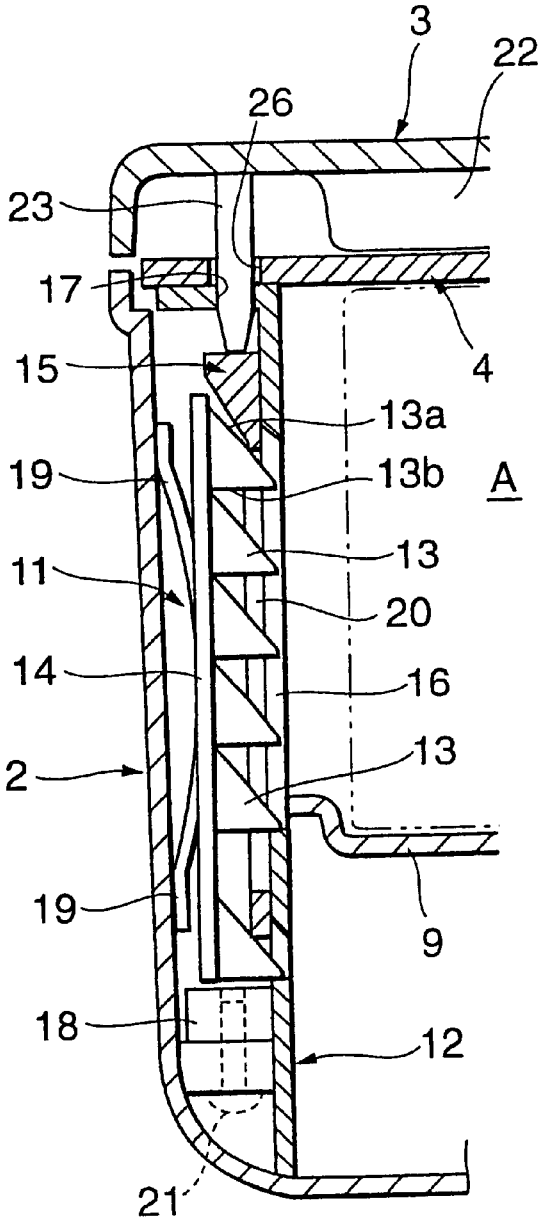
FIG. 3A is a sectional view of an essential part of the lifting plate locking device shown in FIG. 2 in an inoperative state.
Figure 3B:
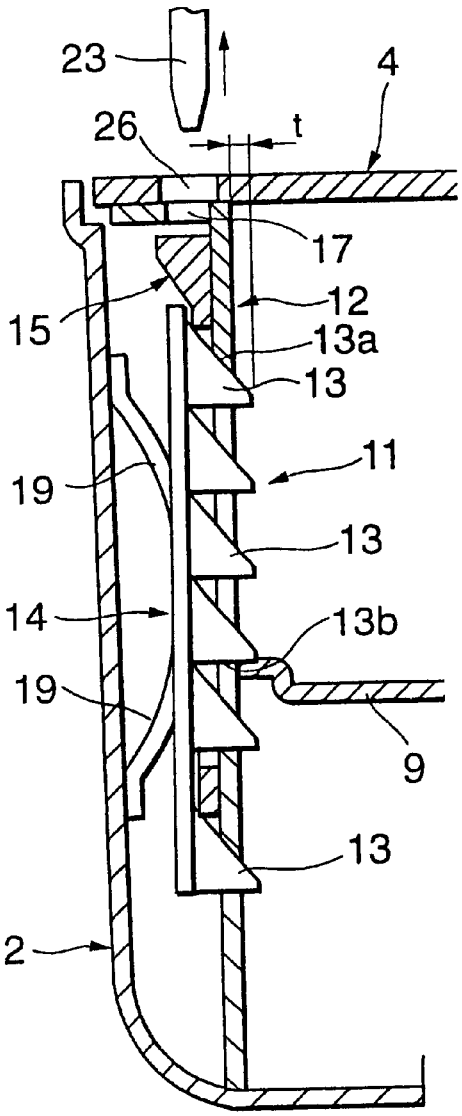
FIG. 3B is a sectional view of an essential part of the lifting plate locking device shown in FIG. 2 in an operative state.
Figure 4:
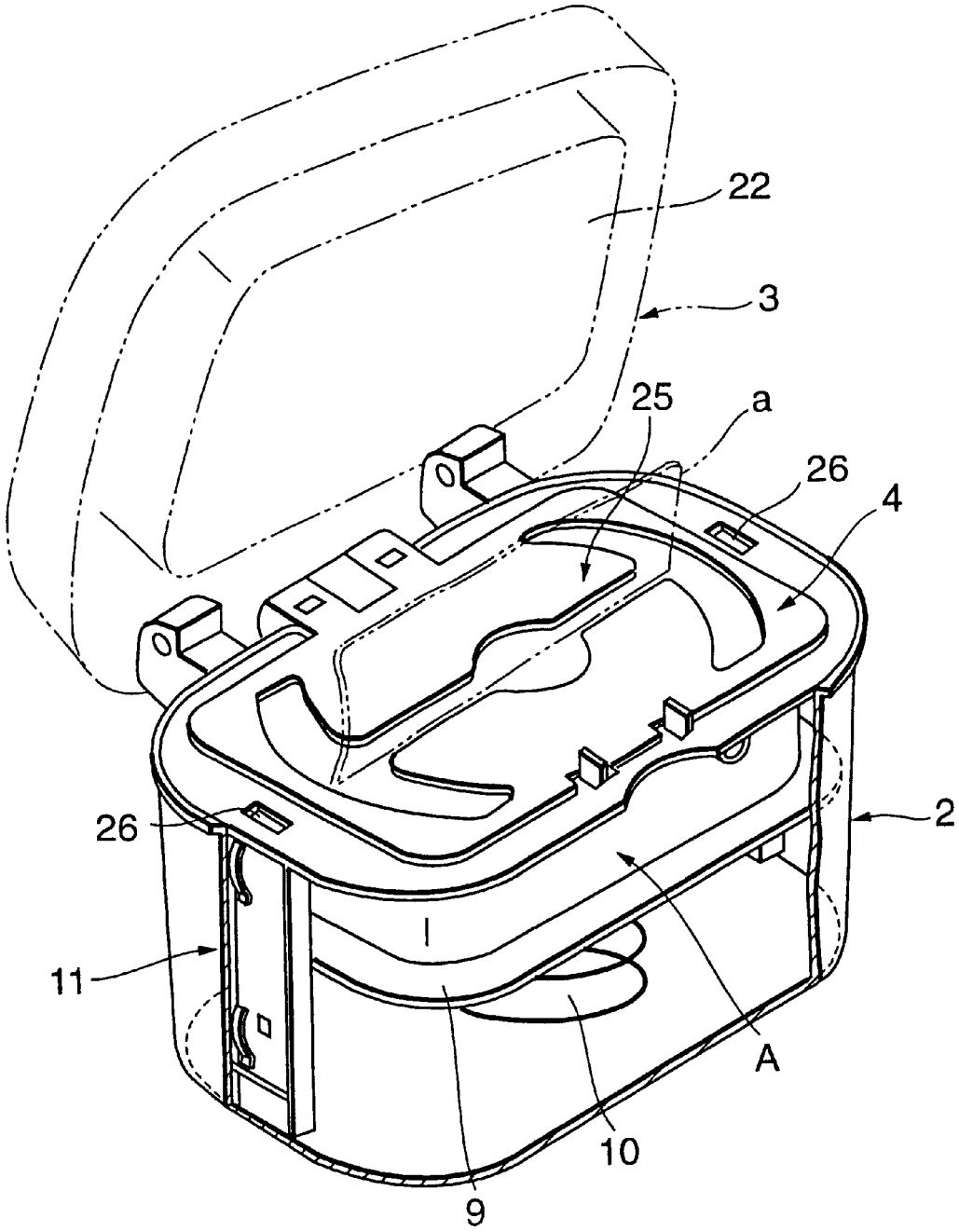
FIG. 4 is a perspective view of the wet tissue warmer shown in FIG. 1 in a state where a wet tissue is being taken out.

FIG. 1 is an exploded perspective view of the wet tissue warmer in a first embodiment according to the present invention, FIG. 2 is an exploded perspective view of a lifting plate locking device, which is a principal part of the wet tissue warmer shown in FIG. 1, FIGS. 3A and 3B are sectional views of an essential part of the lifting plat locking device shown in FIG. 2, and FIG. 4 is a perspective view of the wet tissue warmer shown in FIG. 1 in a state where a wet tissue a is being taken out.

As shown in FIG. 1, a wet tissue warmer 1 includes a case 2 having an open upper end 2*a*, a lid 3 covering the open end 2*a* and capable of being opened and closed, and an inner lid 4 between the case 2 and the lid 3. Sides of the lid 3 and the inner lid 4 of the wet tissue warmer 1 are connected respectively by hinges 5 and 6 to the case 2. Sides of the lid 3 and the inner lid 4 opposite those hinged to the case 2 are fastened to the case 2 by catching devices 7 and 8. The case 2 has a substantially rectangular horizontal section corresponding to the shape of a wet tissue package A. A lifting plate 9 is placed in the case 2. The lifting plate 9 is biased upward by a compression coil spring (first spring) 10 extended between the lifting plate 9 and the bottom wall of the case 2.

Lifting plate locking devices 11 are disposed on the opposite end walls 2*b* of the case 2 to lock the lifting plate 9 biased upward. Each lifting plate locking device (movement obstructing means) 11 includes a covering member 12 as shown in FIG. 2 that are joined to the end walls 2*b* of the case 2 to define a space, a locking member 14 provided with a plurality of teeth 13 that engage the lifting plate 9 (FIG. 1), and an operating plate 15 that operates the locking member 14 according to the opening and closing operations of the lid 3. The covering member 12 has a U-shaped horizontal section. The covering member 12 has a front wall 12*a* extending opposite to the end wall 2*b* of the case 2 and provided with a rectangular slot 16. The covering member 12 has a top wall 12*b* provided with a slot 17. The front wall 12*a* of the covering member 12 is provided on the back surface of a lower part thereof with a rib 18. The teeth 13 of the locking member 14 are formed in a vertical arrangement on a surface of a base 14*a*. Elastic strips (second springs) 19 that work as leaf springs are formed on middle parts of the opposite side walls of the base 14*a*. The strips 19 are curved backward. The operating plate 15 is provided with an opening 20 in its central part, and a top end wall 15*a* extending backward.

As shown in FIG. 3A, a screw 21 is screwed into the rib 18 to fasten the covering member 12 to the case 2. The operating plate 15 is extended on the back surface of the front wall 12*a* so as to be vertically movable. The locking member 14 is extended along the back surface of the operating plate 15 with the teeth 13 thereof received in the opening 20 of the operating plate 15 and the slot 16 of the covering member 12. In the lifting plate locking device 11 thus assembled, the locking member 14 is biased toward the interior of the case 2 by the strips 19.

The lid 3 has a heating unit 22 (FIG. 1) having a built-in heater and formed on the lower surface thereof. Projections 23 (FIG. 1) projects from the opposite ends of the lid 3. The lid 3 is provided on its upper surface with a knob 24 (FIG. 1).

The inner lid 4 is formed of an elastic resin or the like in the shape of a thin plate and is provided with an H-shaped tissue opening 25 having a slit 25*b* and circular slots 25*a* connected to the opposite ends of the slit 25*b*, respectively. A circular opening 25*c* is formed in a middle part of the slit 25*b*. Slots 26 are formed in the opposite ends of the inner lid 4, respectively. The inner lid 4 can be moved in a direction in which a wet tissue a included in the wet tissue package is pulled to take out the same. In a state where the lid 3 is closed, the inner lid 4 is in contact with the lower surface of the lid 3 to transmit heat generated by the heating unit 22 to the wet tissue package A. When the lid 3 is opened, the lifting plate locking devices 11 lock the lifting plate 9. Two flexible portions of the inner lid 4 defining the H-shaped wet tissue opening 25 are bent elastically and the slit 25*b* is expanded when a wet tissue a is pulled, so that the wet tissue a can be easily taken out. An inner lid other than the inner lid 4 provided with the H-shaped wet tissue opening 25 may be used, provided that the material and construction of the inner lid permit the inner lid to flex in a direction in which a wet tissue a is pulled to take out the same.

The lid 3 and the inner lid 4 are connected so as to be opened and closed to the case 2 by the hinges 5 and 6, respectively. The wet tissue package A is mounted on the lifting plate 9 placed in the case 2, and then the inner lid 4 is closed. In this state, the lifting plate 9 is biased upward by the spring 10 to press the upper surface of the wet tissue package A against the inner lid 4.

When the lid 3 is closed to store the wet tissues a, the projections 23 of the lid are inserted through the slots 17 of the covering members 12 of the lifting plate locking devices 11 into the covering members 12 and depress the operating plates 15 as shown in FIG. 3A. Consequently, the upper edge of the opening 20 of the operating plate 15 and the lower edge of the operating plate 15 of each lifting plate locking devices 11 are engaged with the inclined upper surfaces 13*a* of the top and the bottom tooth 13 of the locking member 14, respectively, to push the locking member 14 down. Thus, the locking member 14 is retracted toward the end wall of the case 2 against the resilience of the elastic strips 19. Then, the lifting plate 9 is released and, consequently, the lifting plate 9 can be moved upward by the spring 10 to press the wet tissue package A mounted on the lifting plate 9 against the inner lid 4. Although the inner lid 4 is interposed between the heating unit 22 and the wet tissue package A, the wet tissues a in upper layers of the wet tissue package A can be held near the heating unit 22 of the lid 3 and can be efficiently heated.

When the lid 3 is opened to use the wet tissues a, the projections 23 of the lid 3 are pulled out of the slots 26 of the inner lid 4 and the slots 17 of the covering members 12 as shown in FIG. 3B. Consequently, the elastic strips 19 of the locking member 14 of each lifting plate locking device 11 push the locking member 14 away from the end wall 2*b* of the case 2 and the operating plate 15 is raised by the teeth 13 of the locking member 14. In this state, the edges of the teeth 13 project by a distance t from the front surface of the front wall 12*a* of the covering member 12 and the horizontal lower surface 13*b* of the tooth 13 immediately above the edge of the lifting plate 9 are engaged with the lifting plate 9 to hold the lifting plate 9 against the resilience of the spring 10 and to restrain the same from upward movement.

When the wet tissue a is pulled to take the same out of the wet tissue package A, portions of the inner lid 4 around the wet tissue opening 25 are bent upward by the wet tissue a as shown in FIG. 4 and a space is formed between the inner lid 4 and the wet tissue package A accordingly. Thus, the wet tissue a can be easily taken out from the case 2.

In the wet tissue warmer 1 in the first embodiment, each tooth 13 of the locking member 14 of each lifting plate locking device 11 has the inclined upper surface 13*a*, the operating plate 15 is pressed against the inclined upper surfaces 13*a* of the teeth 13 to retract the locking member 14 from its locking position to release the lifting plate 9. The operating plate 15 is released so that the locking member 14 is able to advance to the locking position so that the horizontal lower surface 13*b* of the tooth 13 engages the lifting plate 9 to restrain the lifting plate 9 from upward movement. Since the portions of the elastic inner lid 4 around the wet tissue opening 25 are bent and a space is formed between the inner lid 4 and the wet tissue package A when the wet tissue a is pulled, the wet tissue a can be easily taken out from the case 2.

Figure 5A:
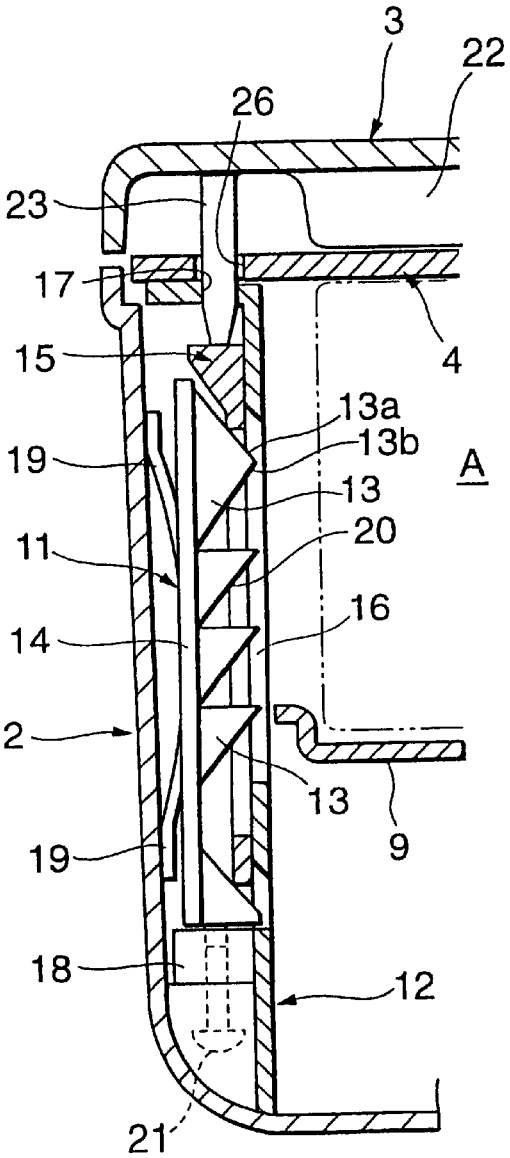
FIG. 5A is a sectional view of a first modification of the lifting plate locking device of the wet tissue warmer shown in FIG. 1 in an inoperative state.
Figure 5B:
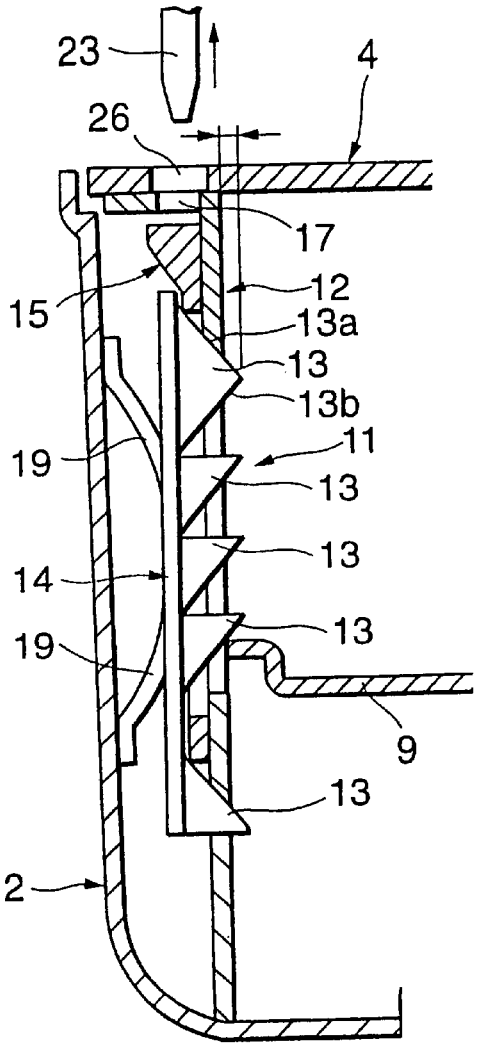
FIG. 5B is a sectional view of the lifting plate locking device shown in FIG. 5A in an operative state.

FIG. 5A shows a lifting plate locking device in a modification of the lifting plate locking device 11 included in the wet tissue warmer in the first embodiment. As shown in FIG. 5A, a locking member 14 is provided with teeth 13 each having an inclined lower surface 13*b*. When the locking member 14 is released, the inclined lower surface 13*b* of the tooth 13 in contact with the lifting plate 9 depresses the lifting plate 9 as shown in FIG. 5B.

Figure 6A:
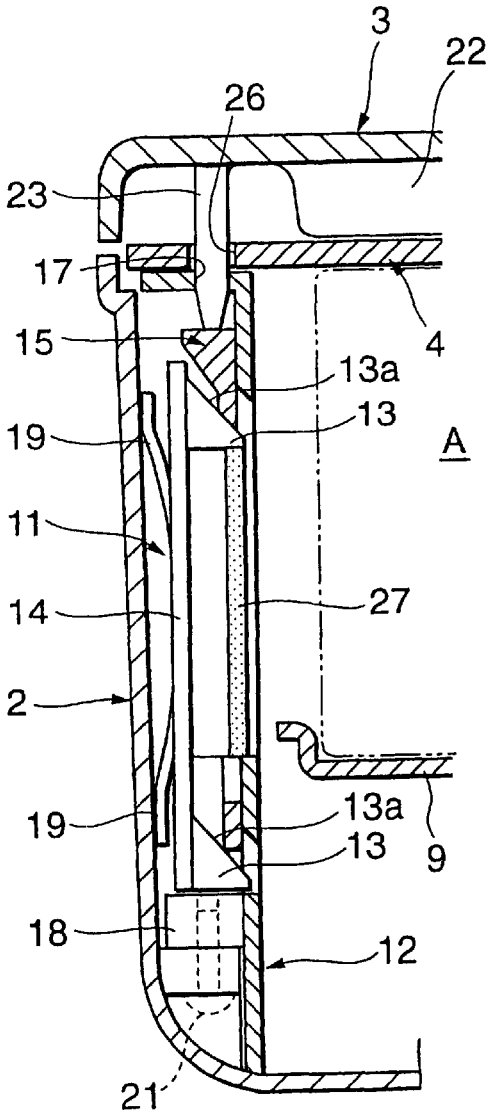
FIG. 6A is a sectional view of a second modification of the lifting plate locking device of the wet tissue warmer shown in FIG. 1 in an inoperative state.
Figure 6B:
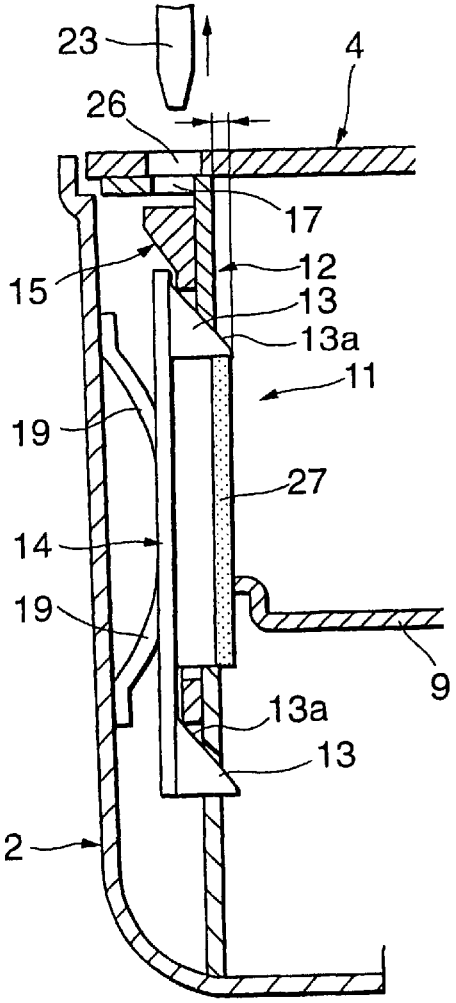
FIG. 6B is a sectional view of the lifting plate locking device shown in FIG. 6A in an operative state.

FIG. 6A shows a lifting plate locking device in a second modification of the lifting plate locking device of the wet tissue warmer in the first embodiment. A locking member 14 is provided with only two teeth 13 corresponding to the top and the bottom tooth 13 of the lifting plate locking device 11 included in the wet tissue warmer in the first embodiment, and a friction plate 27. The friction plate 27 is a substitute for the teeth 13 between the top and the bottom tooth 13 of the lifting plate locking device 11 included in the wet tissue warmer in the first embodiment. The operating plate 15 comes into contact with the inclined upper surfaces 13*a* of the top and the bottom tooth 13 to operate the locking member 14. When the locking member 14 is released from the operating plate 15 as shown in FIG. 6B, the friction plate 27 is pressed against the lifting plate 9 to restrain the lifting plate 9 from upward movement.

In the wet tissue warmers in the first embodiment and the modifications, the locking member 14 is extended along the inner surface of the end wall of the case 2 so as to be moved toward and away from the end wall, the locking member 14 is moved toward the interior of the case 2 when the lid 3 is opened to bring the tooth 13 or the friction plate 27 of the locking member 14 into engagement with a peripheral part of the lifting plate 9 to lock the lifting plate 9 at the present position. The elastic strips 19 of the locking member 14 may be omitted and the locking member 14 may be biased by a coil spring or the like. The locking member 14 may be received in a space formed in the case 2 instead of the space defined by the covering member 12; the locking member 14 may be operated by any one of various operating structures other than the operating plate 15. The locking member 14 may be operated directly by the projection 23 of the lid 3. The locking member 14 does not need necessarily to be interlocked with the lid 3; the locking member 14 may be operated by a push button or an operating lever incorporated into the lid 3 or a wall of the case 2.

Figure 7B:
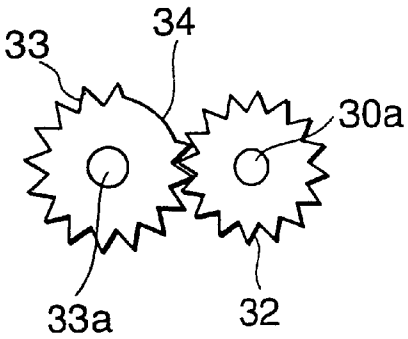
FIG. 7B is a view of a driving gear and a driven gear.
Figure 7A:
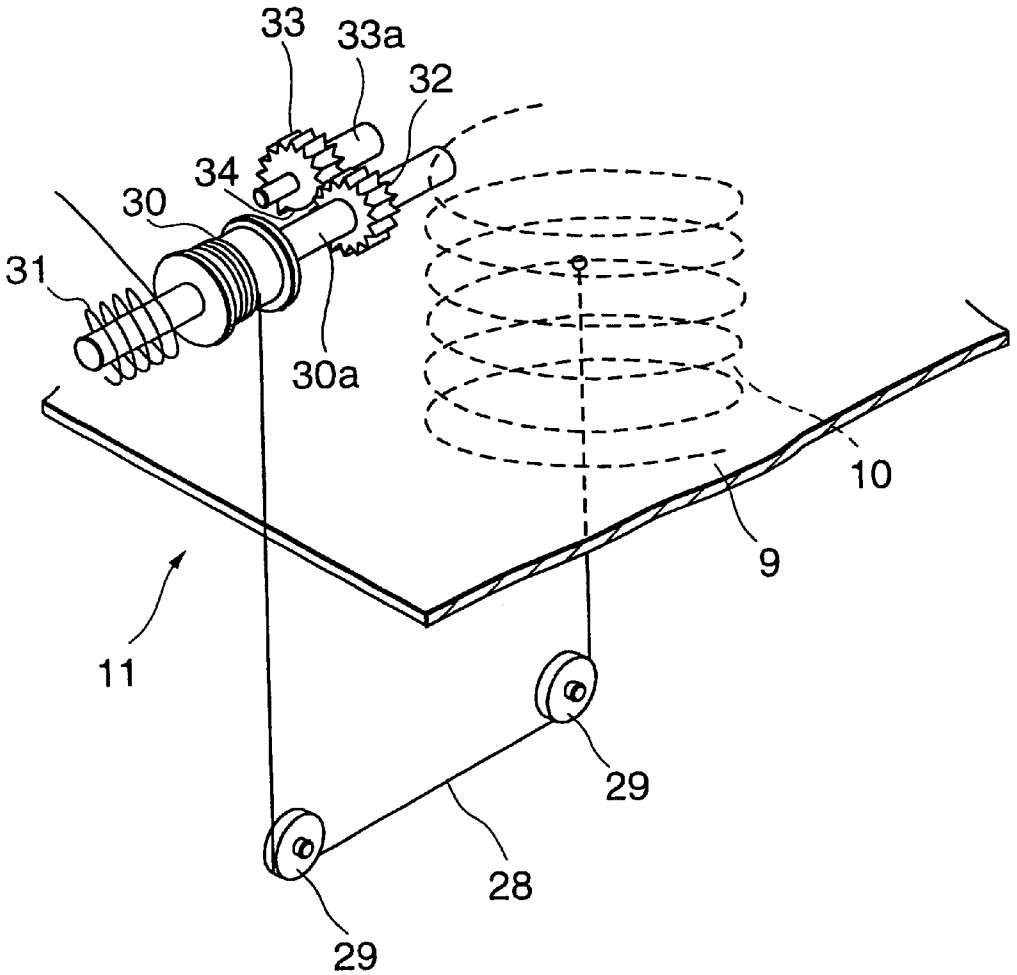
FIG. 7A is a conceptional perspective view of a lifting plate locking device included in a wet tissue warmer in a second embodiment according to the present invention.
Figure 8:
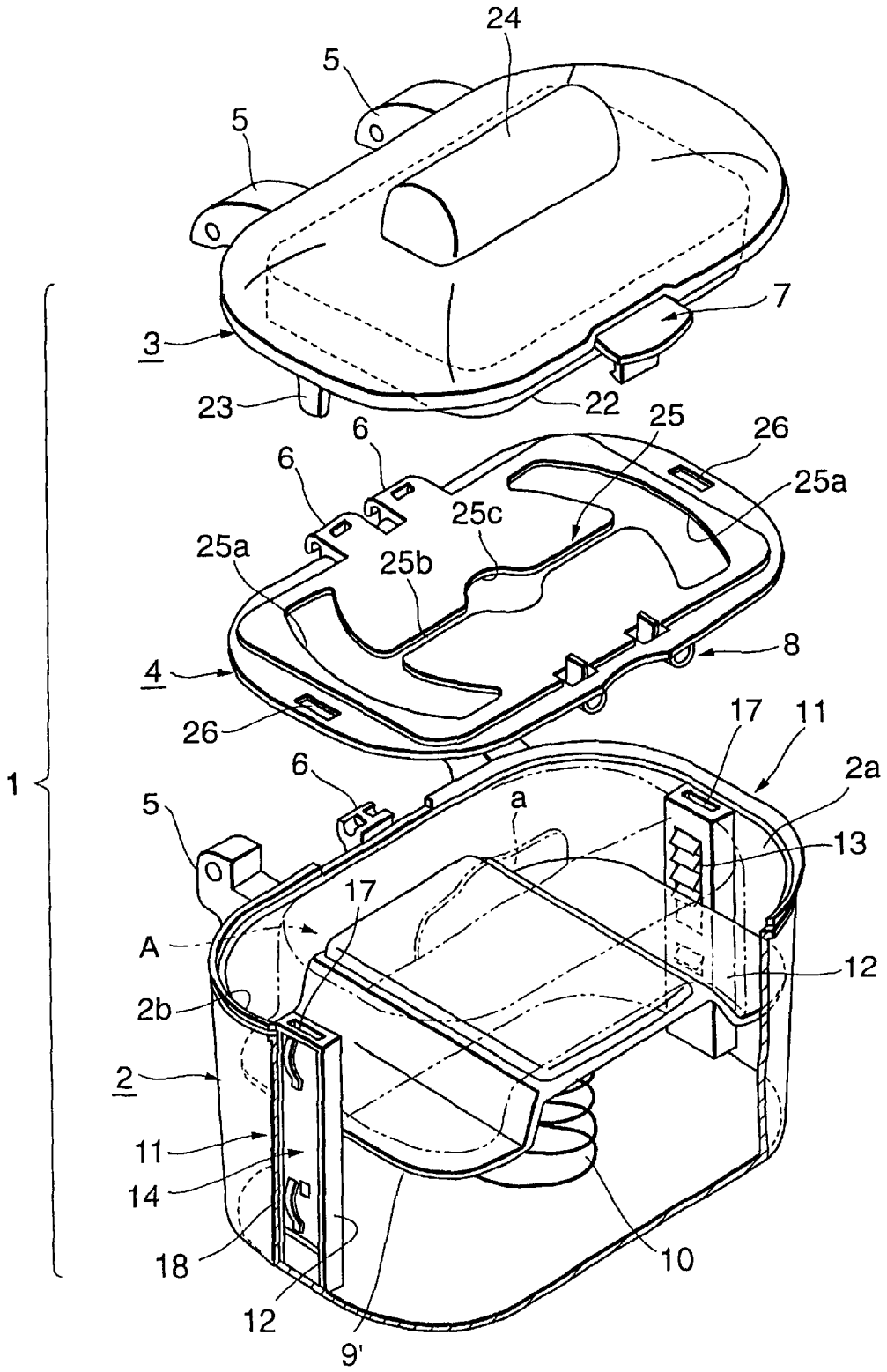
FIG. 8 is an exploded perspective view of a wet tissue warmer provided with a lifting plate formed in the shape of a raised bottom and having a raised central part

FIGS. 7A and 7B is a conceptional perspective view of a lifting plate locking device 11 included in a wet tissue warmer in a second embodiment according to the present invention. As shown in FIG. 7A, a wire 28 has one end connected to the lower surface of a lifting plate 9 and the other end attached to a drum 30 supported on an upper part of a case 2. The wire 28 is extended through pulleys 29 and is wound round the drum 30. The drum 30 is biased for turning in one direction by a torsion coil spring (third spring) 31. A driven gear 32 is fixedly mounted on the shaft 30*a* of the drum 30, and a driving gear 33 is engaged with the driven gear 32. The shaft 33*a* of the driving gear 33 is connected, for example, to a hinge 5 connecting a lid 3 to a case 2 so that the driving gear 33 is turned by the opening operation of the lid 3. The driving gear 33 is an incomplete gear having a tooth-lacking section 34. When the lid 3 is closed, the tooth-lacking section 34 coincides with the driven gear 32 and hence the gears 32 and 33 are disengaged with each other. The torsion coil spring 31 functions only to take up a slack in the wire 28 and the biasing force of the torsion coil spring 31 is very low as compared with the biasing force of a coil spring 10 biasing the lifting plate 9 upward.

The gears 32 and 33 of the lifting plate locking device (movement obstructing means) 11 thus constructed are disengaged when the lid 3 is closed. Therefore, the lifting plate 9 is biased upward by the coil spring 10 to raise a wet tissue package A mounted thereon. When the lid 3 is opened, the driving gear 33 is turned, the driving gear 33 and the driven gear 32 are engaged and the drum 30 is rotated to wind the wire 28. Consequently, the lifting plate 9 is lowered together with the wet tissue package A against the biasing force of the coil spring 10 and thereby pressure acting on the wet tissue package A is reduced. This state is maintained as long as the lid 3 is open.

In the lifting plate locking device (movement obstructing means) 11 employed in the second embodiment, the drum 30 is supported on the case 2, one end of the wire 28 is connected to the lifting plate 9 and the other end of the wire 28 is wound on the drum 30. The drum 30 is rotated and the wire 28 is taken up by the opening action of the lid 3 to lower the lifting plate 9. The drum 30 may be rotated by any one of various rotative driving mechanisms. For example, the driven gear 32 may be engaged with a rack formed on the lid 3 and the driven gear 32 may be driven by the rack to rotate the drum 30. The rack must have a tooth-lacking section.

The driving gear 33 is driven for rotation by the opening and closing operations of the lid 3 in the second embodiment. The driving gear 33 may be driven for rotation by a suitable mechanism other than that employed in the second embodiment; the driving gear 33 may be operated by a push button or an operating lever incorporated into the lid 3 or a wall of the case 2. The case 2 may be provided with a small built-in motor to drive the driving gear for rotation, which will reduce force necessary to open and close the lid 3.

Figure 13:
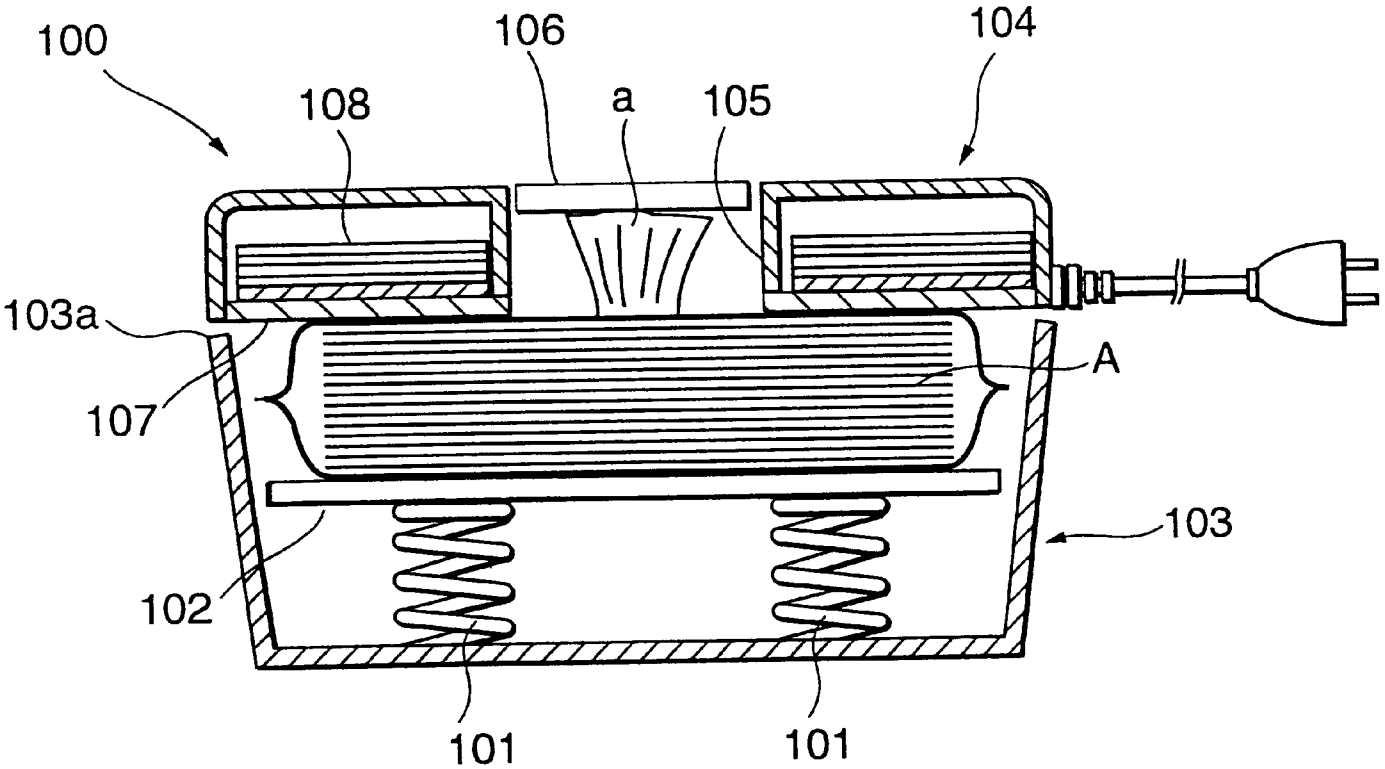
FIG.13 (PRIOR ART)
FIG. 13 is a sectional view of a conventional wet tissue warmer.

In either the wet tissue warmer in the first embodiment or the wet tissue warmer in the second embodiment, the entire lid 3 is opened. Naturally, a wet tissue warmer according to the present invention my be provided with a small lid like the small cover 106 of the wet tissue warmer shown in FIG. 13 and only the small lid may be opened and closed.

Figure 9:
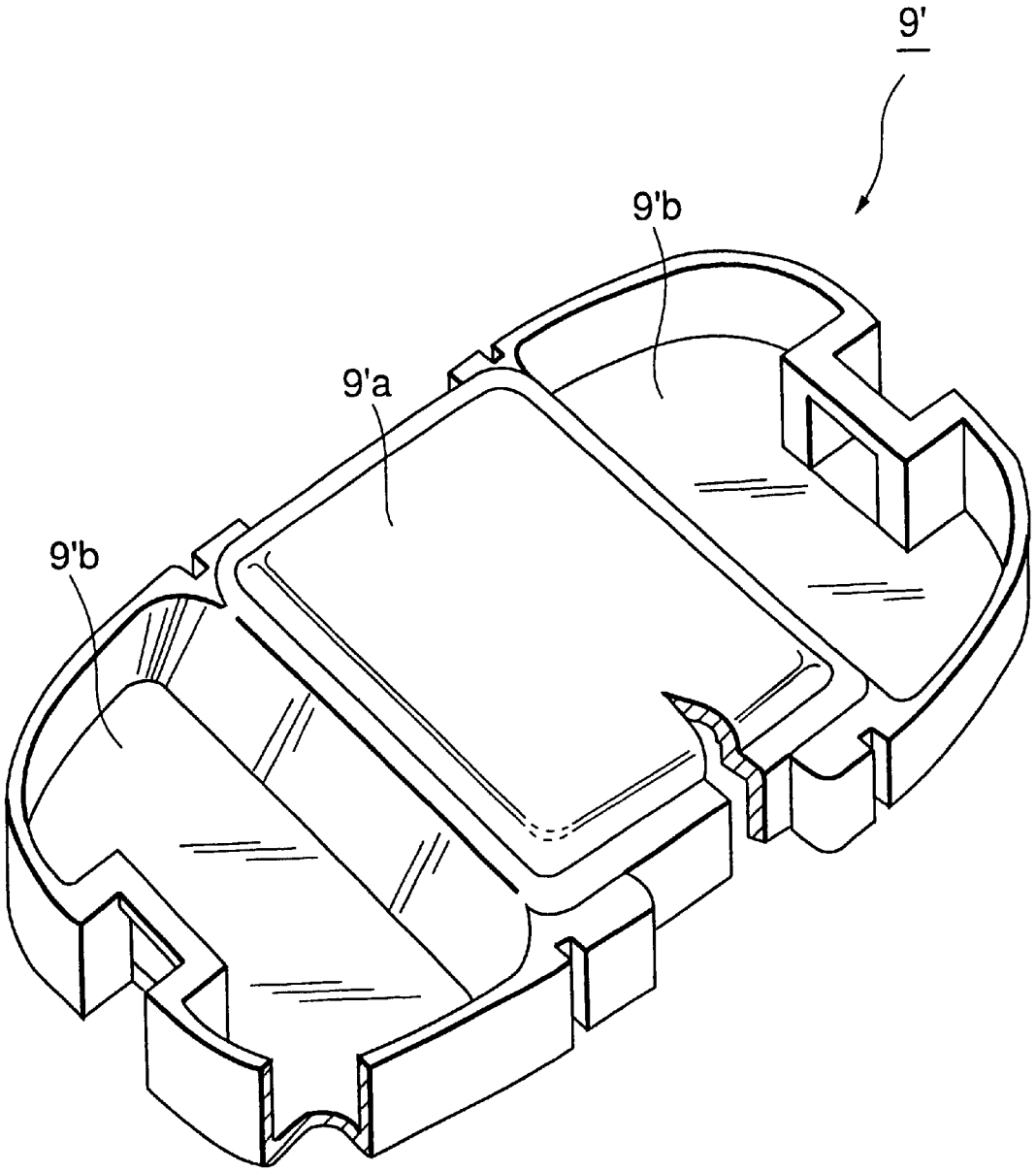
FIG. 9 is a perspective view of the lifting plate shown in FIG. 8.

Although the wet tissue warmers in the first and the second embodiment are provided with the flat lifting plates 9, it is desirable, in view of properly applying the present invention to wet tissue warmers for containing wet tissue packages of various types available on the market, to employ lifting plates formed in the shape of a raised bottom and having a raised central part as shown in FIGS. 8 to 12. A lifting plate 9' shown in FIG. 9 is formed in the shape of a raised bottom and has a central raised part 9'*a* and flat bottom parts 9'*b*. The superiority of the lifting plate 9' having the central raised part 9'*a* to the flat lifting plate 9 will be described with reference to FIGS. 10A and 10B.

Wet tissue packages of various sizes are on the market. Large wet tissue packages are, for example, 165 mm×105 mm×65 mm and 170 mm×90 mm×50 mm, respectively. A small wet tissue package is, for example, 155 mm×85 mm×45 mm. End parts of some wet tissue packages are soft and those of some other ones are comparatively hard and difficult to collapse.

When a wet tissue package A having soft end parts is placed on the lifting plate 9 and the inner lid 4 and the lid 3 are pressed against the wet tissue package A to heat the wet tissues, the wet tissue package A can be easily collapsed by the pressure exerted thereon by the compression coil spring 10 and the wet tissue package A can be pressed against the inner lid 4. Therefore, any particular problems do not arise. When a wet tissue package A having hard end parts A1 which are relatively hard to collapse is contained in the wet tissue warmer, the end parts A1 of the wet tissue package A cannot be collapsed by the pressure F of the compression coil spring 10 and a space of a thickness $t_2$ is formed. Consequently, the wet tissues a contained in the wet tissue package A cannot be pressed against the inner lid 4. Therefore, a compression coil spring capable of exerting a pressure higher than the pressure F exerted by the compression coil spring 10 must be used. However, such usage of the compression coil spring with a higher pressure makes it difficult to take out a wet tissue a from the wet tissue warmer.

Figure 10A:
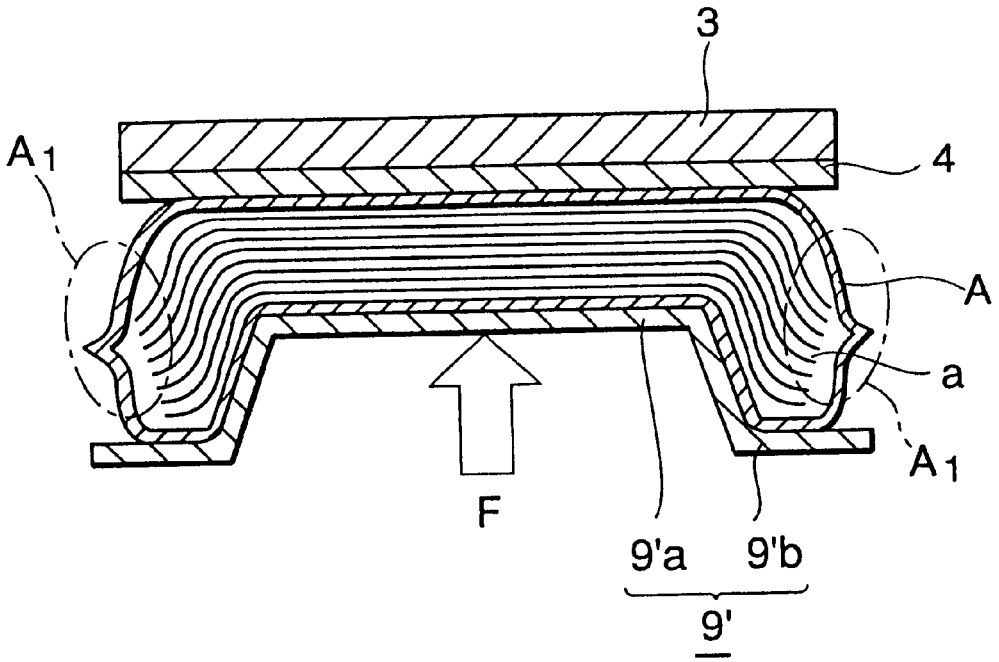
FIG. 10A is a view of assistance in explaining the effect of the lifting plate formed in the shape of a raised bottom.
Figure 10B:
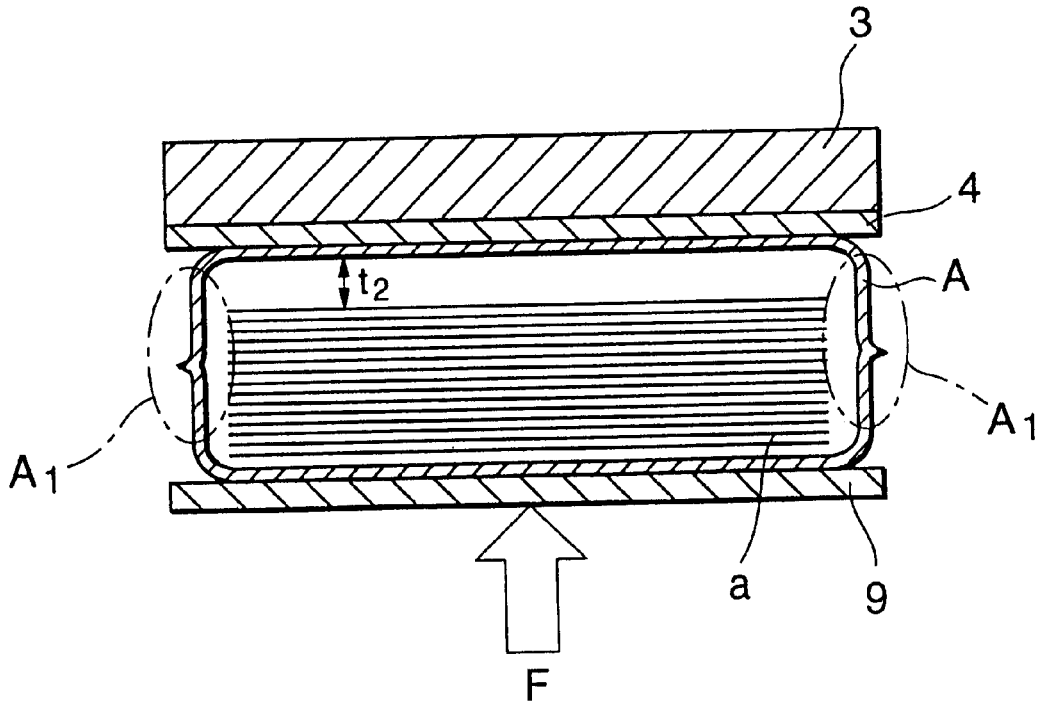
FIG. 10B is a view of assistance in explaining the effect of a flat lifting plate.
Figure 11:
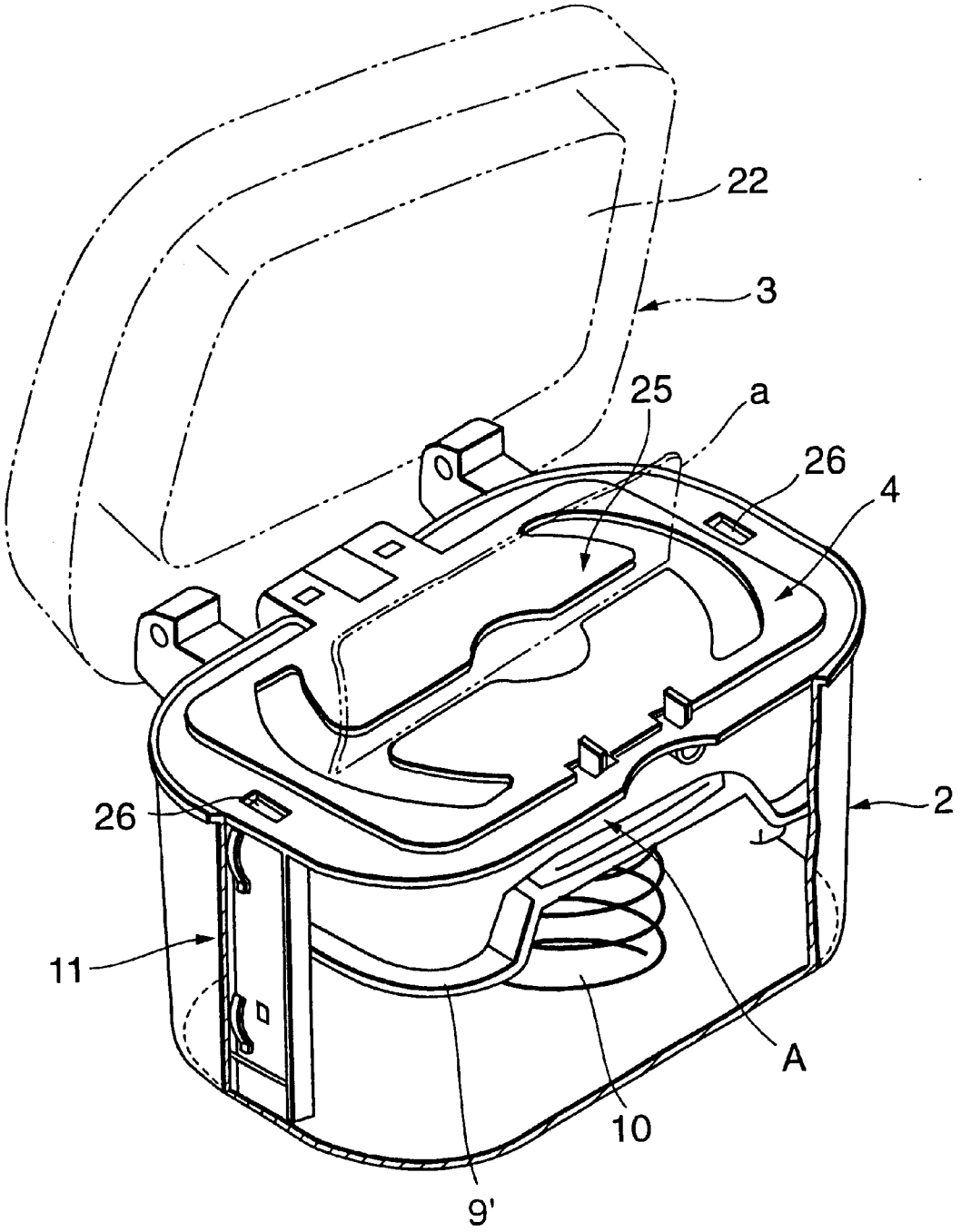
FIG. 11 is a perspective view of the wet tissue warmer shown in FIG. 8 in a state where a wet tissue is being taken out.
Figure 12:
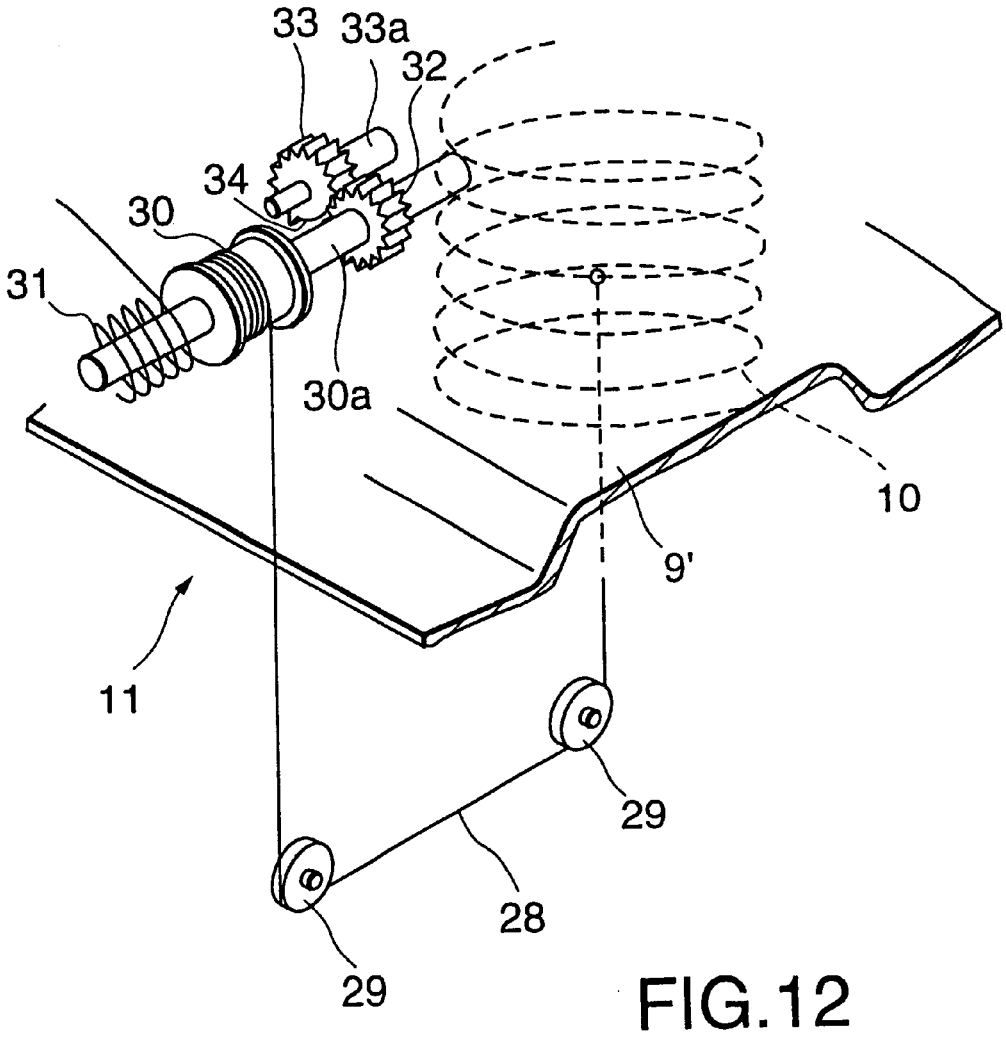
FIG. 12 is a view of another lifting plate locking device of a lifting plate that can be incorporated into the wet tissue warmer shown in FIG. 8.

FIG. 10A is a view of assistance in explaining the effect of the lifting plate 9' having the central raised part 9' a as shown in FIGS. 9 to 12. Suppose that the wet tissue package A has hard end parts A1 relatively difficult to collapse. When the wet tissue package A is mounted on and raised by the lifting plate 9' , a pressure F is applied to only a central part of the wet tissue package A by the central raised part 9'*a* of the lifting plate 9' , the central part of the wet tissue package A is collapsed and the relatively hard end parts A1 remain uncollapsed over the flat bottom parts 9'*b*. Consequently, the top wet tissue a contained in the wet tissue package A can be pressed against the inner lid 4.

The lifting plate 9' having the raised central part 9'*a*, as compared with the flat lifting plate 9, needs a relatively low resilience to lift up the wet tissue package A. Therefore, the lifting plate 9' having the raised central part 9'*a* presses the wet tissue package A against the inner lid 4 by a relatively low pressure and hence the wet tissues a can be easily taken out from the wet tissue warmer. When the wet tissue warmer is designed so as to heat a portion of the upper surface of the wet tissue package A around the wet tissue dispensing opening, the wet tissue package A can be properly pressed against the heating unit 22 and hence the thermal efficiency of the heating unit 22 can be improved.

Practically, a central part of a wet tissue a is used for wiping and hence the central part of the wet tissue a needs to be heated. Therefore, any particular problem does not arise even if a peripheral part of the wet tissue a is not heated sufficiently.

As apparent from the foregoing description, the wet tissue warmer according to the present invention includes the case having an open end, a lid removably put on the case so as to cover the open end of the case and internally provided with a heater, and a lifting plate placed in the case and biased upward. When the lid is closed, the wet tissue package mounted on the lifting plate is pressed against the lid to heat the wet tissue package. The case is provided with the movement obstructing means to lock the lifting plate at the present position by the movement obstructing means when the lid is opened.

According to the present invention, when taking out a wet tissue from the wet tissue warmer, application of pressure to the wet tissue package can be deterred by locking the lifting plate by the movement obstructing means. Therefore, the wet tissue package is pressed against the heating unit by a high pressure when the lid is closed to store the wet tissues to heat the wet tissues satisfactorily. The wet tissue can be easily taken out from the wet tissue warmer by deterring the pressing of the wet tissue package against the heating unit when taking out the wet tissue.

What is claimed is:

1. A wet tissue warmer for warming a wet tissue package including a wet tissue, said wet tissue warmer comprising:

a case having an open end;

a lid removably positioned on the case so as to cover the open end of the case;

a heater disposed internally of the lid;

a lifting plate, placed in the case, for supporting a wet tissue package;

a first spring engaging the lifting plate and biasing the lifting plate upward so as to press the wet tissue package against the lid; and movement obstructing means for obstructing upward movement of the lifting plate, the movement obstructing means including a plurality of locking members placed in the case, wherein each of the locking members are provided with teeth capable of engaging the lifting plate.

2. The wet tissue warmer according to claim 1, wherein each locking member is provided with second springs in contact with an end wall of the case to bias the locking member toward the interior of the case, the lid is provided with projections projecting downwardly, and an operating plate is disposed contiguously with each locking member, the operating plate being operated by the corresponding projection of the lid so as to move the locking member toward the end wall against force exerted by the second springs on the locking member when the lid is closed.

3. The wet tissue warmer according to claim 2, wherein each locking member is provided with a plurality of teeth formed in a vertical arrangement, the top and the bottom tooth of the plurality of teeth each have an inclined upper surface that engages the operating plate.

4. The wet tissue warmer according to claim 2, wherein each locking member and each operating plate are placed in a space defined by a covering member disposed in the case and provided with an opening, and the teeth of the locking member project through the opening of the covering member toward the interior of the case when the lid is opened.

5. The wet tissue warmer according to claim 1, wherein each of the teeth of each locking member has a horizontal lower surface that is engaged with the lifting plate.

6. The wet tissue warmer according to claim 1, wherein each of the teeth of each locking member has an inclined lower surface that is engaged with the lifting plate.

7. The wet tissue warmer according to claim 1, further comprising an inner lid disposed between the lid and the lifting plate and being warped in a direction in which the wet tissue is pulled to take out the same.

8. The wet tissue warmer according to claim 1, wherein the lifting plate has a raised central part.

* * * * *